US005907281A

United States Patent [19]

Miller, Jr. et al.

[11] Patent Number: 5,907,281

[45] Date of Patent: May 25, 1999

[54] SWIMMER LOCATION MONITOR

[75] Inventors: Benjamin K. Miller, Jr., League City, Tex.; James E. Halwachs, Panama City, Fla.; Arnold J. Farstad, Boulder, Colo.

[73] Assignee: Johnson Engineering Corporation, Webster, Tex.

[21] Appl. No.: 09/072,680

[22] Filed: May 5, 1998

[51] Int. Cl.[6] ..... G08B 23/00

[52] U.S. Cl. ..... 340/573.6; 340/573.1; 340/539; 367/131; 367/141

[58] Field of Search ..... 340/573.1, 573.6, 340/525, 539, 604; 367/142, 160, 910, 99, 107, 110, 131, 141

[56] References Cited

U.S. PATENT DOCUMENTS

| | | | |
|---|---|---|---|
| 3,602,877 | 8/1971 | Currie | 340/573 |
| 3,953,843 | 4/1976 | Codina | 340/573 |
| 3,969,712 | 7/1976 | Butman et al. | 340/573 |
| 4,079,364 | 3/1978 | Antenore | 340/573 |
| 4,121,200 | 10/1978 | Colmenero | 340/539 |
| 4,187,502 | 2/1980 | Beverly et al. | 340/566 |
| 4,305,143 | 12/1981 | Simms et al. | 340/573 |
| 4,307,449 | 12/1981 | Strubin | 364/418 |
| 4,336,591 | 6/1982 | Berdzar et al. | 364/418 |
| 4,337,527 | 6/1982 | Delagrange et al. | 367/98 |
| 4,459,689 | 7/1984 | Biber | 367/107 |
| 4,549,169 | 10/1985 | Moura et al. | 340/573 |
| 4,635,242 | 1/1987 | Hart | 367/134 |
| 4,747,085 | 5/1988 | Dunegan et al. | 340/573 |
| 4,932,009 | 6/1990 | Lynch | 340/566 |
| 4,949,072 | 8/1990 | Comerford et al. | 340/573 |
| 4,999,606 | 3/1991 | Comerford et al. | 340/573 |
| 5,006,831 | 4/1991 | De Solminihac | 340/573 |
| 5,019,822 | 5/1991 | Kirkland | 342/22 |
| 5,049,859 | 9/1991 | Arnell | 340/573 |
| 5,097,254 | 3/1992 | Merrithew | 340/573 |
| 5,408,222 | 4/1995 | Yaffe et al. | 340/573 |
| 5,619,187 | 4/1997 | Serfontein | 340/573 |

*Primary Examiner*—Nina Tong
*Attorney, Agent, or Firm*—Fulbright & Jaworski L.L.P.; Ross E. Davidson

[57] ABSTRACT

A system is disclosed for locating swimmers who could be in danger of drowning, as determined by preset parameters such as the time duration that they remain at a depth where breathing is impossible. In this system, each individual swimmer wears a Swimmer Location Monitor (SLM). This is a miniature electronic device that not only determines the extent of the swimmer's danger but also emits an electromagnetic alarm signal whenever such a danger exists. At each occurrence, an alarm, which may be audible and/or visual, is sounded on the surface while the swimmer's location is tracked in real time from the signals received on an antenna network deployed along the bottom of the swimming area. These signals are combined in a central processor and the computed real-time location is displayed graphically on a monitor to guide the guard personnel in rescue operations. The invention is intended for use in pools, beaches, water parks and other swimming areas.

11 Claims, 6 Drawing Sheets

SWIMMER LOCATION MONITOR

CROSS REFERENCE TO RELATED APPLICATIONS

Not applicable.

STATEMENT REGARDING FEDERALLY SPONSORED RESEARCH

Not applicable.

BACKGROUND OF THE INVENTION

There are a wide variety of safety concerns regarding swimming, particularly at swimming pools, water parks, and beaches. In many instances, despite the presence of life guards, help for a swimmer in trouble comes far too late to prevent drowning. Even with adequate staffing numbers, lifeguards often find it difficult to monitor, effectively and safely, large numbers of swimmers.

There have been numerous attempts at developing automatic alarm equipment to warn of swimmers in danger. Several inventions have focused on protecting children and non-swimmers from drowning in backyard swimming pools (See e.g., U.S. Pat. Nos. 3,953,843; 3,969,712; 4,079,364; 4,121,200; 4,187,502; 4,747,085; 5,049,859). These devices typically monitor for the undesired presence of a body in a swimming pool such as from a slip or fall. However, these devices are often not effective for monitoring active swimming areas where persons have intentionally entered the water.

Other swimmer safety devices address the protection of scuba divers (See e.g., U.S. Pat. No. 4,307,449). Many of these devices operate simply by measuring the total amount of time in the water, or by measuring the amount of time spent at a given depth. For example, measuring the duration of a scuba dive (U.S. Pat. No. 4,307,449), or monitoring the time period of a scuba diver's maximum depth (See e.g., U.S. Pat. No. 4,336,591). Unfortunately, these devices do not determine whether a swimmer is in distress or experiencing other difficulties. Nor are these devices useful for determining the location of a swimmer.

Some devices for detecting a swimmer in the water are known. Many of these detection methods rely on some variation of an acoustic or sound based technique. For example, U.S. Pat. No. 4,337,527 describes a system that uses ultrasonic transmission through the water to identify underwater targets. A human operator listening to the headphone output classifies the target and determines its location. U.S. Pat. No. 4,459,689 describes an apparatus utilizing combination energy transmitting and receiving transducer for detecting and locating objects within a plurality of zones. U.S. Pat. No. 4,635,242 describes an underwater signaling device utilizing acoustic sound generators. However, these devices are not capable of monitoring crowded swimming environments.

A few devices for detecting swimmers in distress are known. (See e.g., U.S. Pat. Nos. 4,932,009 and 5,097,254 describe systems for detecting distressed swimmers). However these inventions use acoustic transducers rather than electromagnetic antennas. Furthermore, these devices do not pinpoint the location of distressed swimmers.

U.S. Pat. No. 5,019,822 entitled Marine Object Detector describes a system that uses low frequency electromagnetic transmission through the water and measures amplitude and phase anomalies caused by intruding swimmers in a protected area. This patent has the objective of protecting bridges, piers etc. of military importance from being destroyed by explosive charges. However, this invention only monitors the presence of an undesired swimmer and does not permit the monitoring of swimmers in areas where their presence is desired.

Therefore, of particular interest is the development of a system for monitoring large numbers of swimmers in a swimming pool, beach area, or water park. Such a system would be capable not only of monitoring the swimming status of a large number of swimmers, but would also be capable of pinpointing the exact location of a swimmer in distress with sufficient warning to permit a timely rescue.

All references cited herein are incorporated by reference.

BRIEF SUMMARY OF THE INVENTION

The present invention overcomes many of the disadvantages of the prior art in tracking swimmers in pools, beaches, and water parks. The prior methods using acoustic waves and ultrasonics suffer sensor and/or signal discrimination errors from line-of-sight limitations, signal reflections from the boundaries of the pool structure, air bubbles introduced into the water, and from signal recognition errors in crowded swimming areas. By using low frequency (500 Hz–25,000 Hz) electromagnetic coupling between the miniature inductive transmitters worn by the swimmers to large loop antennas, or other suitable receiving antennas on the bottom surface, most of these disadvantages are overcome. The present invention utilizes electromagnetic means to protect swimmers.

An objective of the invention is to provide an improved apparatus or system for detecting and locating swimmers at risk in a timely manner that would facilitate their rescue and eliminate many of the drownings that occur each year. This objective can also encompass locating non-swimmers or small children who enter the water.

The invention provides a low frequency electromagnetic surveillance system for tracking the location of swimmers who may be in peril. The invention includes the equipping of each swimmer with an individual Swimmer Location Monitor (SLM) that transmits a pulsed, low frequency alarm when specified thresholds, for example, of time and depth, monitored by the SLM are exceeded. The invention is capable of generating an electromagnetic field through the water from a transmitter contained in the SLM where the electromagnetic field is subsequently transmitted to a receiver for the magnetic field transmission in the swimming area. The invention also is capable of amplifying, filtering and processing the received signals resulting in a graphical and/or numerical display of the distressed swimmer's location. The invention is also capable of triggering an alarm (audible or visual) whenever specified thresholds are exceeded.

The invention provides a miniaturized electronic device, or SLM, that can be worn by a swimmer to enhance his/her safety during recreational swimming in crowded pools, beaches and water parks. The SLM can detect or measure swimmer distress by any number of criteria, including, but not limited to, detecting water pressure, detecting water depth, the amount of time spent in the water, submersion in water, and/or any combination of these.

The invention provides a device to transmit an electromagnetic field which is generated in a series tuned ferrite coil antenna or other similar hardware. The invention further provides a method of electromagnetic field transmission through the water from a miniaturized solid state switching transmitter contained in the SLM.

The invention also provides a magnetic field transmission receiver which comprises a network of multi-turn loop antennas, or other suitable receiving antennas, deployed in the swimming area. In one preferred embodiment the invention provides a system in which the antennas are deployed along the bottom of a swimming pool, or in the swimming area of a beach.

The invention is capable of being automatically powered whenever it is simply immersed in water, or immersed in water at a pre-selected depth and/or period of time, and automatically powering down whenever it leaves the water. The invention further is capable of powering on in a monitor mode. In the monitor mode the unit does not transmit even though it is "on." The invention also provides an alarm which is activated when the SLM is powered on. This mode of operation is useful for detecting persons that are not supposed to be in the water, such as small children.

The invention is also capable of telemetering the data from the swimming area receivers to a central processor via wireless telemetry.

Yet another objective of the invention is to utilize computer systems to detect, display and record all swimmer events of a potentially high risk nature occurring at pools, beaches and water parks. The invention further is capable of recording all swimmer distress events in computer memory for playback and analysis at a later date if necessary.

Other objectives and advantages of the SLM system will be readily appreciated as the invention becomes better understood by reference to the following detailed descriptions when considered in conjunction with the accompanying drawings.

DETAILED DESCRIPTION OF THE INVENTION

Figure 1:
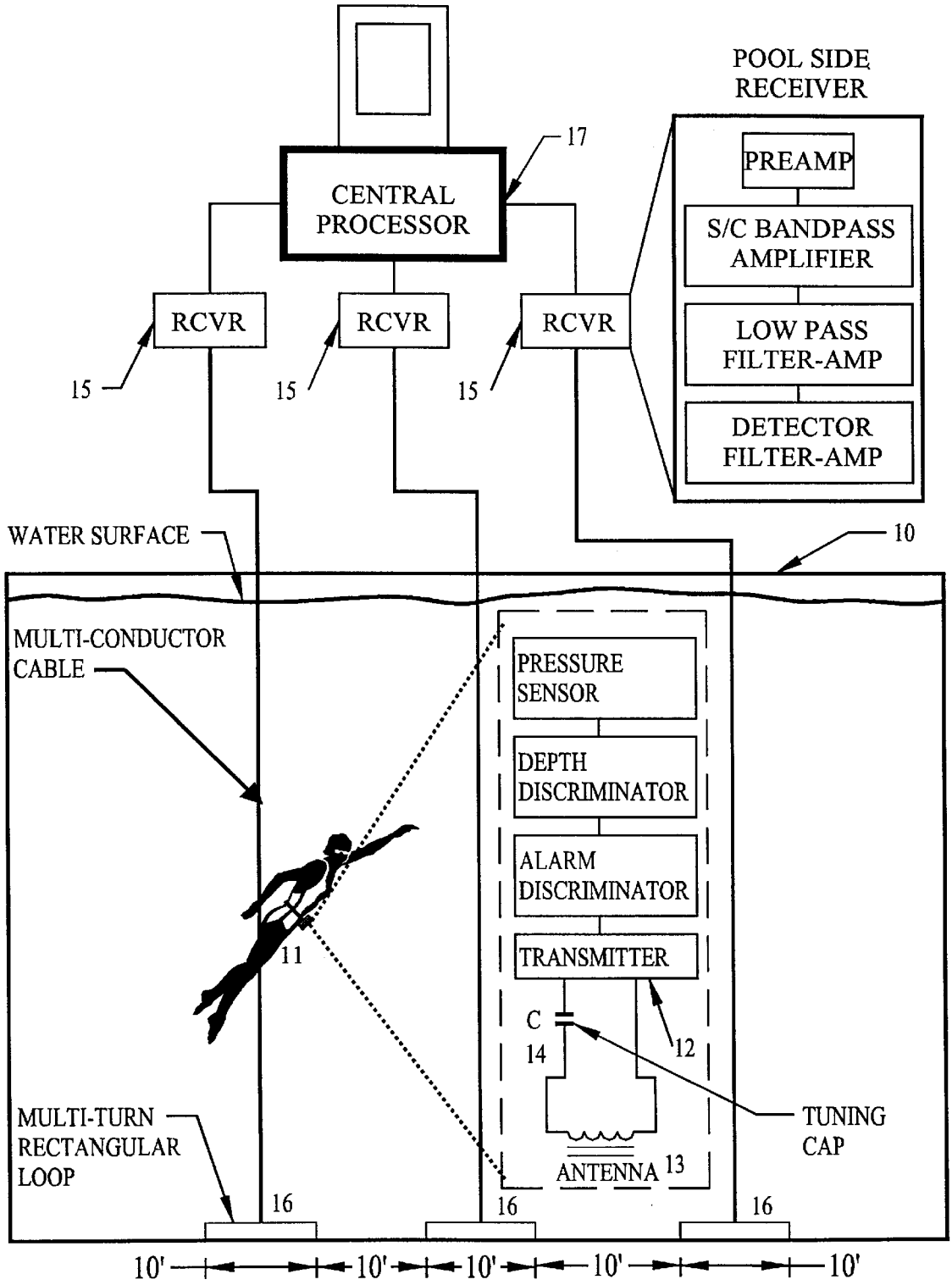
FIG. 1 is a diagrammatic illustration of the Swimmer Location System (SLM) embodying the invention.

As used herein, "low frequency" refers to a range of 500–25,000 Hz.

The present invention is a low frequency electromagnetic surveillance system for tracking the location of swimmers who may be in danger. Each swimmer is equipped with an individual Swimmer Location Monitor (SLM) which transmits a pulsed low frequency alarm when specified thresholds monitored by the SLM (such as depth and time) are exceeded. The invention generates an electromagnetic field through the water from a transmitter contained in the SLM, and the electromagnetic field is subsequently transmitted to a receiver in the swimming area. The invention amplifies, filters, and processes the received signals resulting in a graphical and/or numerical display of the distressed swimmer's location. The invention is also capable of triggering an alarm (audible or visual) whenever specified thresholds are exceeded.

In various embodiments the SLM identifies swimmer distress by detecting water pressure, detecting water depth, the amount of time spent in the water, or submersion in water. However, any criteria related to possible swimmer distress may be employed. The device also may be designed to interpret contact with water as a distress event, for example, to locate small children who have fallen into a swimming area. Other embodiments encompass other suitable receiving antenna systems.

In one embodiment the transmitted electromagnetic field is generated in a series tuned ferrite coil antenna driven by a solid state switching transmitter.

In one embodiment the present invention accurately determines the location of the distressed swimmer by a receiving the magnetic field transmission in a network of multi-turn loop antennas. In one preferred embodiment, the antennas are deployed along the bottom of a pool. In other embodiments, the antennas are deployed at the bottom of the swimming area.

Another embodiment of the present invention additionally can automatically power the SLM whenever it is immersed in water and automatically power down whenever it leaves the water.

Other embodiments of the present invention include a capability of telemetering the data from the receivers to the central processor via wireless telemetry.

Still other embodiments of the invention include a capability of recording all swimmer events related to the use of the SLM in computer memory for playback and analysis at a later date if necessary.

In a preferred embodiment, as a distressed swimmer sinks beneath the surface of the water, his/her SLM senses an anomaly caused by exceeding a threshold water pressure for a threshold time period and triggers the transmitter to begin transmitting its pulsed alarm signal. Because the entire area is covered with a grid of intersecting loop antennas, two or more of these antennas detect the alarm signal and relay the information back to the central processor. The location of the distressed swimmer is determined as the area defined by the intersection of the responding antennas. As the alarm signal is flashed on the video display screen, an accompanying audible and/or visual alarm and location display is provided in the vicinity of the lifeguard station to alert the guard personnel of the swimmer distress.

In a preferred embodiment the invention comprises a process whereby the device worn by the swimmer is activated when certain predefined thresholds of depth and time are exceeded simultaneously. The SLM is packaged in a miniature waterproof enclosure that is normally attached to a belt (other locations are possible) worn by the swimmer. In an alarm situation, the SLM transmits low frequency RF pulses from a low voltage full-wave switching transmitter driving a series-tuned ferrite coil. Sufficient battery power is provided in the SLM device to provide repetitive pulse transmission for a prescribed period of time. The liquid medium for which this system was designed is typical chlorinated water found in most public swimming pools and water parks. However, as a result of the low frequency selected for this system (2500 Hz in this design but other frequencies may be utilized) and the limited distances over which the signals must propagate, the system can also operate effectively in salt water. In a preferred embodiment, the frequency is 2500 Hz. The multi-turn receiving loops each consist of a multi-conductor cable deployed along the swimming area bottom in the form of an elongated rectangular loop (antenna deployment, design, and signal reception/analysis may vary for similar applications of this technology). Each loop is terminated at its receiver input in such a way as to form a multi-turn loop with the same number of turns as are conductors in the cable. Because of the conductive nature of the chlorinated water medium, and the resulting electromagnetic energy losses in the water, there is little or no advantage gained from tuning these antennas. Consequently the tuning is left for the receivers which utilize switched capacitor bandpass amplifiers and low pass filters to reject background noise. The receiver outputs are cabled to a central processor with a CRT monitor that shows the outline of the pool and displays the location of any alarm signals that are detected. An alternate method of transmitting the receiver output signals to the central processor is one that uses short-range wireless telemetry. The SLM terminal equipment may include both video and audio alarm systems as well as a provision for recording all significant events.

Those skilled in the art recognize that the device worn by the swimmer may comprise any of a number of modes of detecting conditions related to the swimmer, that by way of example and not limitation can include the depth in the water, degree of movement, time spent at or under a certain depth or any one of a plethora of devices utilized for monitoring swimmer distress known in industry and in the art.

The following examples are offered by way of illustration and are not intended to limit the invention in any manner.

EXAMPLE 1

SLM System for a Swimming Pool

Figure 2:
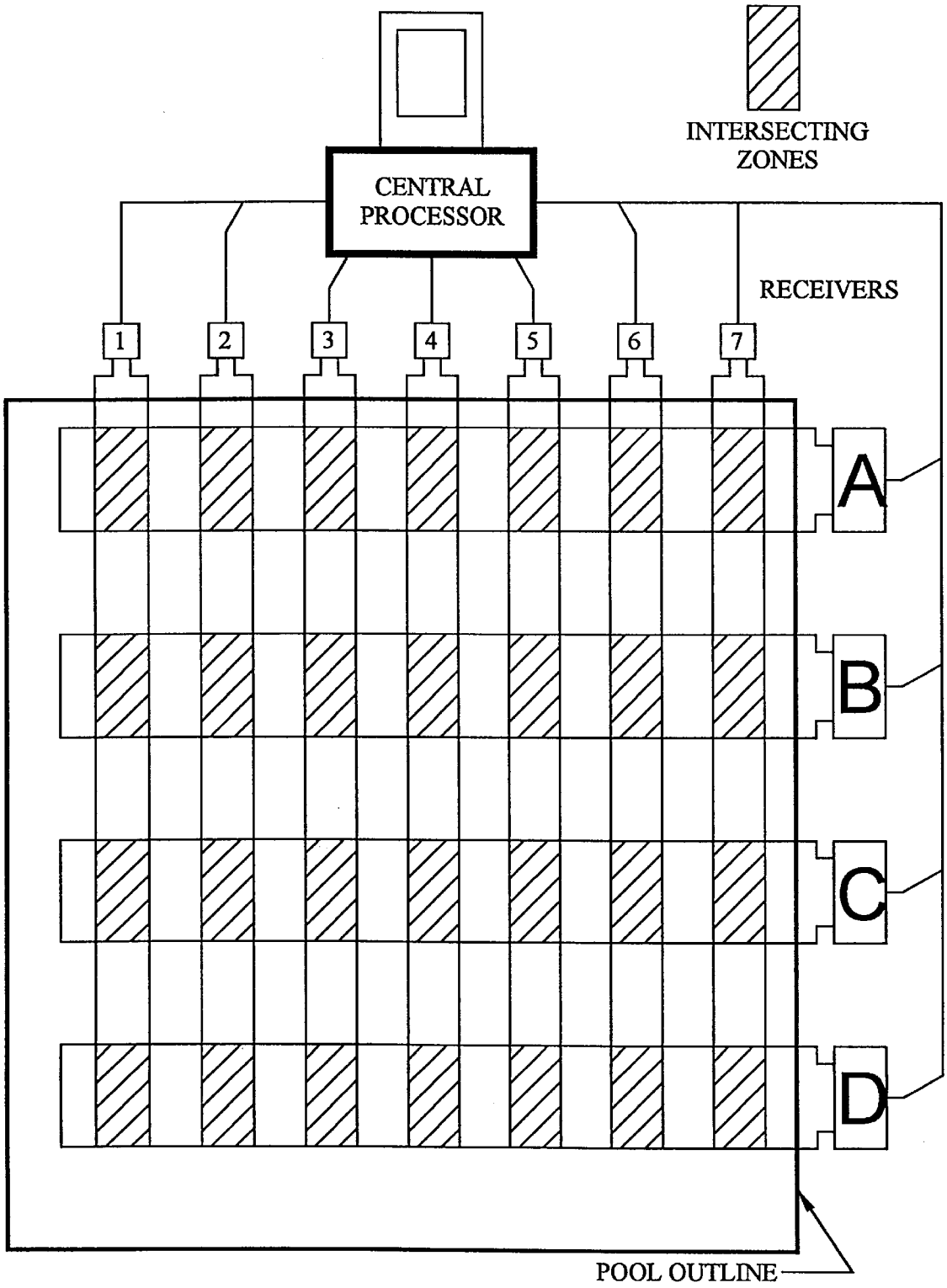
FIG. 2 is a plan view of a typical SLM receiver antenna deployment scheme.

In the illustration provided in FIG. 1 there is shown a Swimmer Location Monitor (SLM) System 10 which is designed to alert guard personnel when a swimmer is at risk. FIG. 2 illustrates a typical SLM deployment. The swimmer wears a small belt-mounted device called the SLM 11 that senses depth over repetitive time intervals and decides when the individual is at risk. The transmitter 12 is a full-wave switching amplifier made up of 2 P-channel MOSFETs and 2 N-channel MOSFETS. The alarm signal is transmitted into a series-tuned ferrite coil antenna 13 and a series capacitor 14. Logic chips in the transmitter limit the transmission to a 10 percent duty cycle of a 2500 Hz square wave with a repetition rate of 1 pulse per second. The ferrite coil antenna consists of a slug of No. 4077375211 ferrite around which are wound 1500 turns of #34AWG Magnet Wire. The core length is 2 inches and the core diameter is ⅜ inch. This antenna, when tuned with a series capacitor of 0.022 $\mu$F will transmit approximately 100 milliamps when powered by a 6 volt battery. The transmitting antenna current moment is equal to the product of the current, the number of turns, the cross-sectional area of the core and the effective permeability of the core. This has been demonstrated to be more than adequate for detection over typical swimming pool dimensions. There is one receiver channel 15 for each receiving antenna 16. A receiver channel consists of a preamplifier, a switched-capacitor bandpass amplifier, a low-pass filter amplifier and a full-wave detector and filter. The output from each receiver detecting a signal is a 100 millisecond pulse with a repetition rate of 1 pulse per second. The outputs of the receivers are cabled to the central processor unit 17 which computes and displays the swimmer's location.

For smaller swimming areas that do not wish to invest in a complete computer and graphic user interface, an LED-type display and alarm panel suffices as a distressed swimmer determining and/or locating element.

The selection of 2500 Hz as the SLM transmitting frequency enables the system to follow the rules of electromagnetic coupling as opposed to radio wave propagation. The electrical conductivity of the liquid medium in most chlorinated pools ranges from 0.1 Siemens/meter to 0.3 Siemens/meter. For salt water, the conductivity increases to approximately 4.0 Siemens/meter. The skin depth is defined as the distance an electromagnetic wave must travel into a conducting medium for it to be attenuated by 37 percent. The expression for skin depth, $\delta$, is given by:

$$\delta=2/(\omega\mu\sigma)^{1/2}$$

$$=503.3/(\sigma f)^{1/2}$$ (assumes $\mu$=the permeability of free space)

where $\delta$=skin depth in meters and $\omega$=radian frequency ($2\pi f$)

$\mu$=magnetic permeability of the medium in Henries/meter (for free space $\mu=4\pi\times10^{-7}$)

Figure 3:
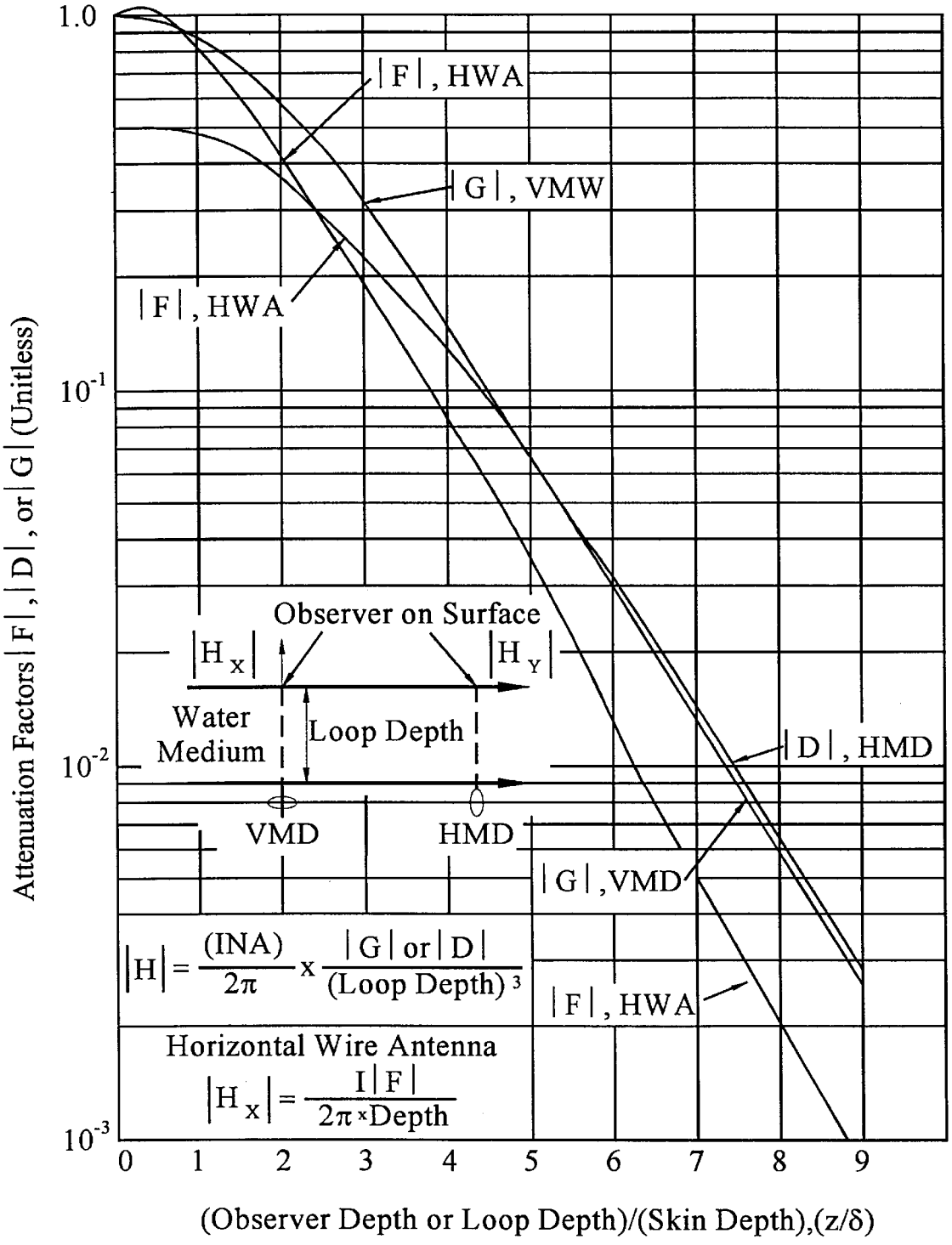
FIG. 3 shows a series of curves illustrating electromagnetic attenuation factors between two antennas as a function of separation distance in a conducting medium such as water.

$\sigma$=electrical conductivity of the medium in Siemens/meter f=frequency in Hz FIG. 3 shows the electromagnetic attenuation coefficients for electromagnetic coupling between two antennas as a function of separation distance in skin depths. For the first skin depth of penetration the attenuation factor does not fall off as rapidly as it does for greater penetrations. The skin depth at 2500 Hz associated with the conductivities specified for chlorinated pools ranges from 32 meters to 18 meters. For salt water, the skin depth is 7 meters. For separation distances that fall within these skin depth values, the electromagnetic coupling properties are not too different from what would be experienced between two antennas coupling in free space. Thus for distances over which the SLM must send its signal in a typical pool environment, the attenuating characteristics of the conductive medium can for the most part be ignored.

EXAMPLE 2

Mode of Operation

The SLM transmitting device 11 worn by the swimmer is packaged in a waterproof container the approximate size of a pack of playing cards. It attaches to an adjustable belt or other means of fastening the device that is worn by the swimmer at all times he/she is in the water, or near the water. Battery power is automatically applied to the device whenever the unit is submerged in the water. Under nonemergency or non-distress conditions the drain on the battery will be insignificant, on the order of a few milliamps. Only when a potentially distressed swimmer event occurs and the unit triggers the transmitter "ON" does the current drain on the battery rise to over 100 milliamps. The SLM unit 11 is designed for at least one hour of transmission under swimmer distress conditions. Because the application of power is automatic, the device can also be used to detect persons who fall in the water.

Under normal operation (for water parks, pools, beaches and other swimming area applications), the SLM unit 11 senses water pressure/depth and triggers a counter to count the time that a predefined water pressure is exceeded (Example: that pressure associated with a 3 ft. depth of the belt worn unit). When that water pressure is exceeded on a continuous basis for a predefined time interval, for example, 30 seconds, a potential swimmer distress is identified, and the transmitter begins transmitting. The electromagnetic energy emitted by the transmitter is detected on two or more of the underwater loop antennas and the SLM location is quickly determined and displayed by the central processor. Also the guard personnel are alerted by an audible and/or visual alarm that is sounded at their duty station, along with a remote display of SLM location.

Figure 4A:
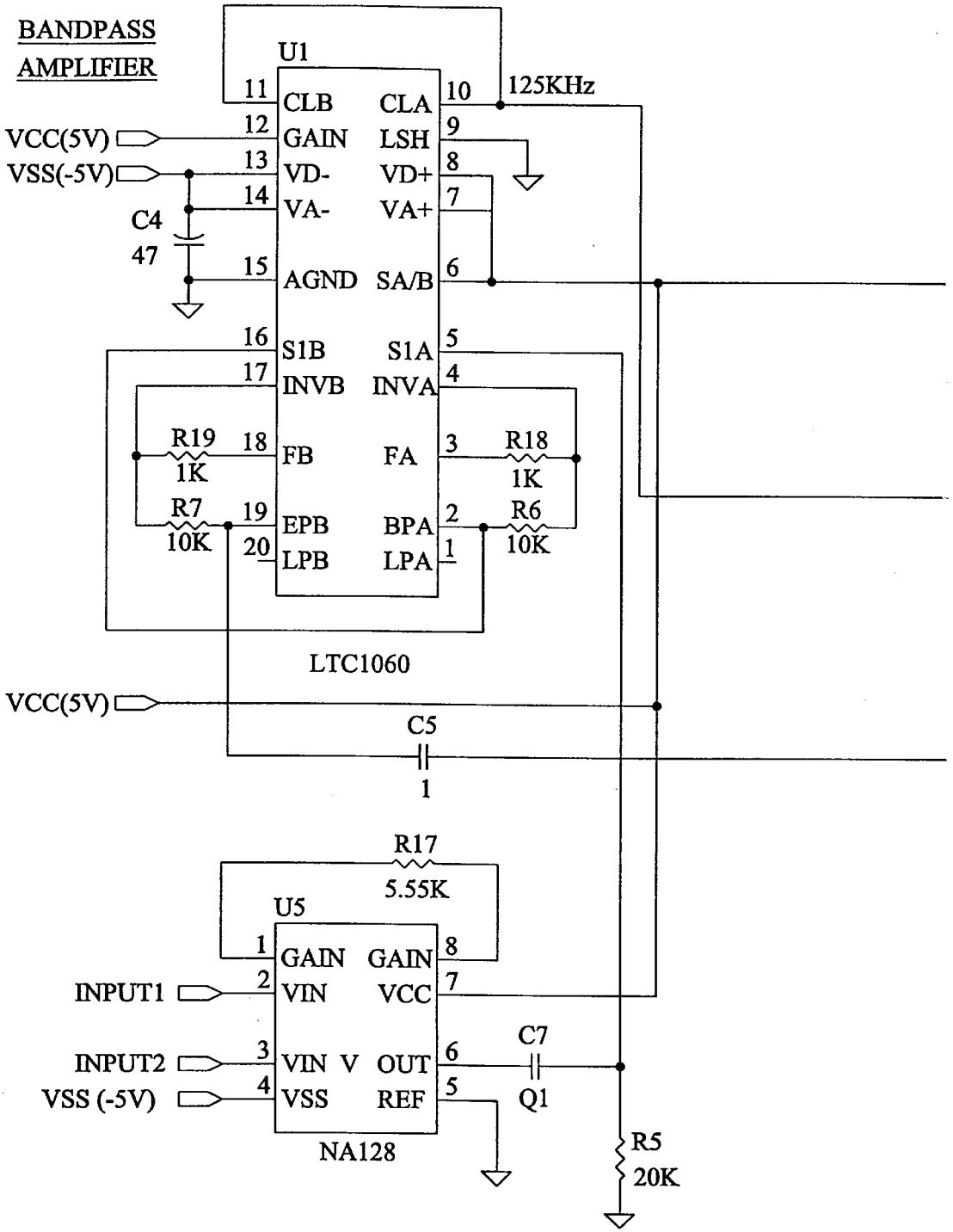
FIGS. 4A–C show a selected version of a schematic diagram of a single receiver channel.
Figure 4B:
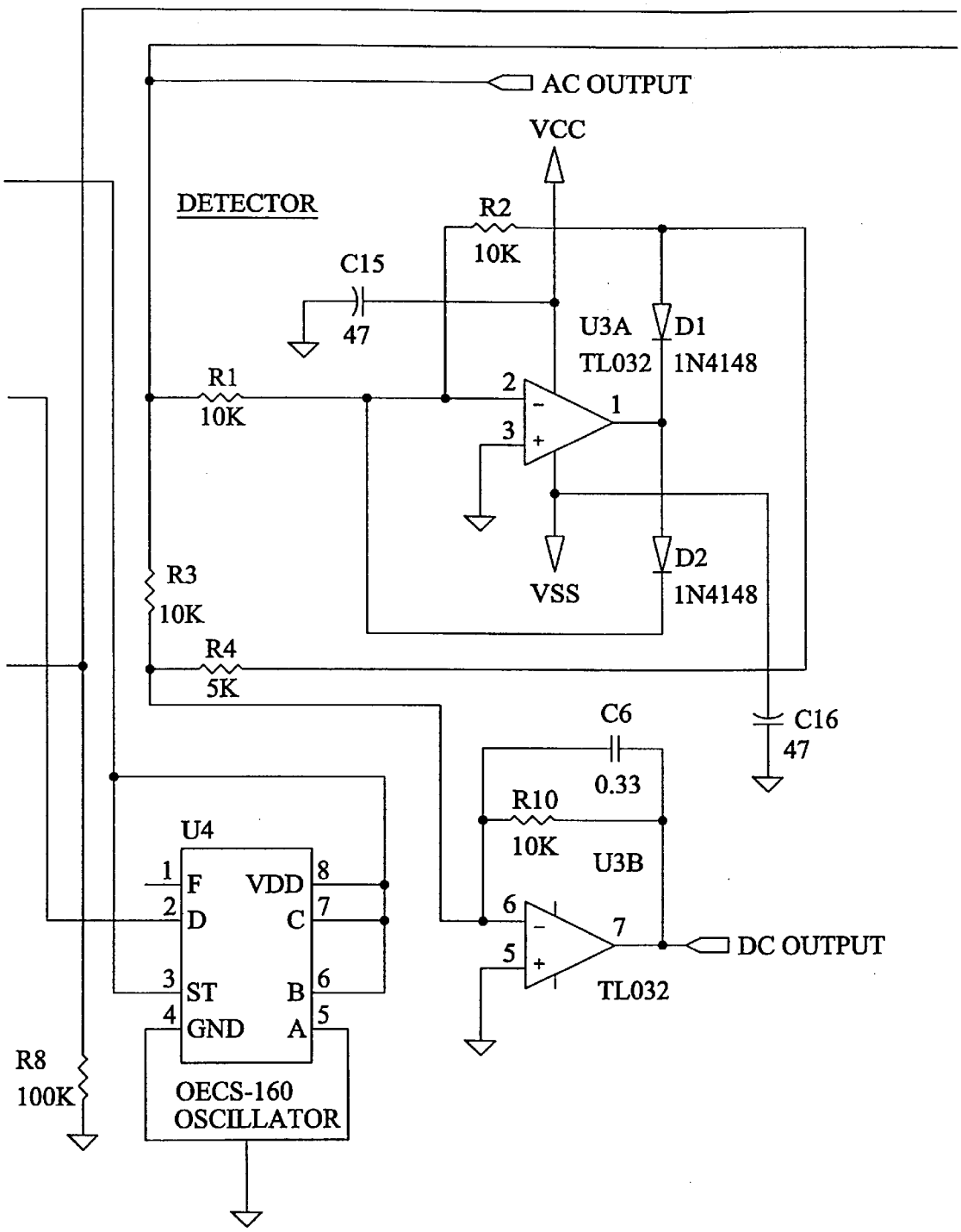
Figure 4C:
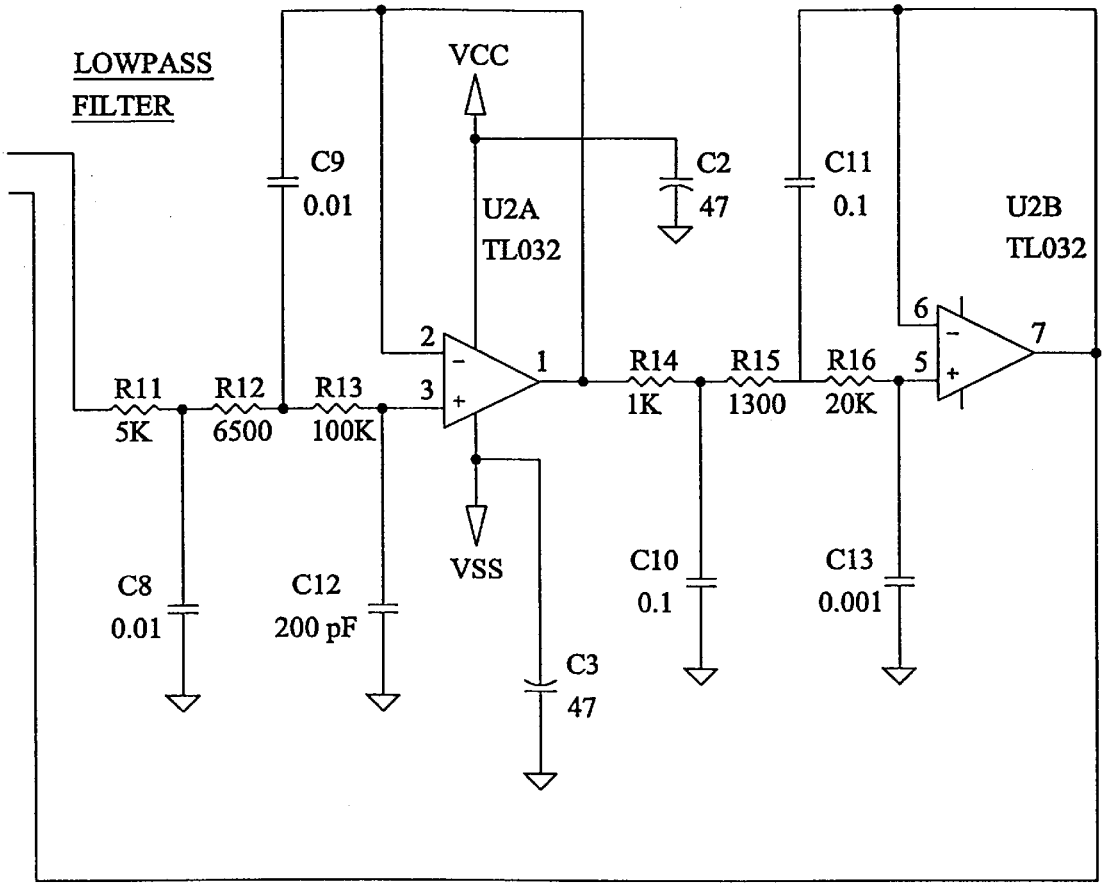

FIGS. 4A–C show a schematic of one of the receiver channels 15. These units are packaged in a water-resistant enclosure since they must be located near the terminals of the antenna as they egress from the pool. They are securely mounted in a protected location and are battery powered using long-life rechargeable batteries. The multi-conductor antenna terminals are connected to the input connectors which are wired internally in sequential fashion to form a multi-turn loop with the two end wires connected to the instrumentation amplifier U5. The signal is amplified by a factor of 10 in U5 and is then fed to the switched-capacitor bandpass amplifier U1. U1 is a two stage amplifier with each stage amplifying the signal by a factor of 10. The bandpass characteristics of U1 are as follows: Center Frequency=2500 Hz, Bandwidth=100 Hz. Switched-capacitor amplifiers must be driven by a clock frequency to provide the desired tuning. In this case the clock frequency of 125 KHz (50 times the tuned frequency) is provided by the Oscillator U4. The remaining circuitry in the receiver consists of a two stage active low-pass filter (U2A and U2B) followed by a two-stage detector-filter combination (U3A and U3B). Since the alarm signal is characterized as a repetitive pulse of 2500 Hz energy operating at a 10 percent duty cycle at a rate of one pulse per second, the receiver output is a dc pulse of 100 millisecond duration appearing every second.

The terminal equipment 17 operates on these pulses in a straightforward manner. A central processing unit consisting of a computer and monitor is used in most cases. Normally they are programmed using a Graphic User Interface (GUI) showing the plan view of the water area of the pool, water park, or beach with flashing symbols to show the location of the transmissions.

All references mentioned in this specification are herein incorporated by reference.

We claim:

1. A low frequency electromagnetic surveillance system for tracking the location of swimmers who may be in danger comprising:

a means for detecting potential or actual swimmer distress for each swimmer equipped with an individual Swimmer Location Monitor (SLM) wherein said means triggers a pulsed low frequency alarm transmission when specified thresholds monitored by said SLM are exceeded;

a means for generating an electromagnetic field through the water from a transmitter contained in the SLM wherein said electromagnetic field is subsequently transmitted;

a means for receiving said magnetic field transmission;

a means for amplifying, filtering and processing the received signals resulting in a display of the distressed swimmer's location; and a means for triggering an audible alarm whenever said specified thresholds are exceeded.

2. The system of claim 1, wherein said low frequency is in the range of 500–25,000 Hz.

3. The system of claim 1, wherein said low frequency is approximately 2500 Hz.

4. The system of claim 1 wherein said SLM measures potential or actual swimmer distress by detecting one or more of the following factors, or any combination thereof: water pressure, detecting water depth, the amount of time spent in the water, or submersion in water.

5. The system of claim 1 wherein said transmitted electromagnetic field is generated in a series tuned ferrite coil antenna driven by a solid state switching transmitter.

6. The system of claim 1 wherein said means for receiving said magnetic field transmission comprises a network of multi-turn loop antennas deployed in the swimming area.

7. The system of claim 6 wherein said antennas are deployed along the bottom of a swimming pool, in the swimming area of a beach, in the water area of a water park, or on the bottom of any swimming area.

8. The system of claim 1, the system further comprising a means for automatically powering the SLM whenever it is immersed in water and automatically powering down whenever it leaves the water.

9. The system of claim 1, the system further comprising means for telemetering the data from said receivers to a central processor via wireless telemetry.

10. The system of claim 1, the system further comprising a means for recording all swimmer distress events in computer memory for playback and analysis at a later date.

11. The system of claim 1 wherein said display is a graphical display, a numerical display, or a combination thereof.

* * * * *